US010010197B1

(12) United States Patent
Krapf et al.

(10) Patent No.: US 10,010,197 B1
(45) Date of Patent: Jul. 3, 2018

(54) DOCUMENT HOLDING APPARATUS

(71) Applicant: W.A. Krapf, Inc., Macedon, NY (US)

(72) Inventors: Christian Q. Krapf, Rochester, NY (US); John Deats, Brockport, NY (US); Michael DiRisio, Rochester, NY (US)

(73) Assignee: W.A. Krapf, Inc., Macedon, NY (US)

( * ) Notice: Subject to any disclaimer, the term of this patent is extended or adjusted under 35 U.S.C. 154(b) by 0 days.

(21) Appl. No.: 15/606,331

(22) Filed: May 26, 2017

(51) Int. Cl.

| | |
|---|---|
| ***B42F 17/00*** | (2006.01) |
| ***A47F 7/14*** | (2006.01) |
| ***A47F 5/02*** | (2006.01) |
| ***B42F 7/06*** | (2006.01) |
| ***B43L 1/00*** | (2006.01) |
| ***A47F 7/00*** | (2006.01) |
| ***A47F 5/00*** | (2006.01) |

(52) U.S. Cl.
CPC ..... *A47F 7/146* (2013.01); *A47F 5/0062* (2013.01); *A47F 5/02* (2013.01); *A47F 7/0042* (2013.01); *A47F 7/145* (2013.01); *B42F 7/06* (2013.01); *B43L 1/00* (2013.01)

(58) Field of Classification Search
CPC .... A47F 7/146; A47F 5/02; A47F 3/04; A47F 7/145; A47F 7/147; A47F 5/0062; A47F 5/08; A47F 5/0018; A47F 7/143; A47F 7/14; A47F 7/0007; A47F 7/0028; A47F 7/0042; A47B 49/004; A47B 63/00; A47B 63/04; A47B 65/00; A47B 53/00; B42F 7/06; B42F 17/00; B42F 17/08; B42F 7/10; B42F 7/12; B42F 7/14; B42F 7/02; B42F 7/00; B43L 1/00
USPC ..... 211/50, 119.004, 11, 56, 55, 52, 128.1, 211/163, 165, 113, 10; D19/90, 86
See application file for complete search history.

(56) References Cited

U.S. PATENT DOCUMENTS

| | | | | | |
|---|---|---|---|---|---|
| 1,658,394 | A * | 2/1928 | Rand | B42F 17/00 | 211/55 |
| 1,858,068 | A * | 5/1932 | Watkins | B42F 17/08 | 211/55 |
| 3,167,873 | A * | 2/1965 | Toms | A47B 81/067 | 211/55 |
| 3,430,774 | A * | 3/1969 | Karkut | B42F 17/08 | 211/10 |
| 3,507,064 | A * | 4/1970 | Hammero | B42F 17/08 | 40/124.2 |
| 3,515,283 | A * | 6/1970 | Poteat | A47B 63/00 | 211/55 |
| 3,838,266 | A * | 9/1974 | Jonathan | A47F 11/10 | 312/117 |

(Continued)

*Primary Examiner* — Jennifer Eleanore Novosad
(74) *Attorney, Agent, or Firm* — Barclay Damon, LLP

(57) ABSTRACT

An apparatus for holding a plurality of documents includes a plurality of dividers. The dividers include a front facing surface, a rear facing surface, an upper end and a lower end. Each divider includes a first attachment member that is attached to a corresponding second attachment member of an adjacent divider so as to form a stacked and interconnected configuration. A frame retains lateral edges of the stacked dividers in which the stacked plurality of dividers define a corresponding plurality of document retaining pockets. In at least one version, the size of the retaining pockets can be selectively and independently adjusted, as needed wherein the apparatus can be used in conjunction with at least one display board, such as a dry-erase board.

20 Claims, 8 Drawing Sheets

(56) References Cited

U.S. PATENT DOCUMENTS 4,003,470 A * 1/1977 Lagorio ..... G09F 5/00 211/50
4,062,452 A * 12/1977 Bartholomew ..... A47B 63/00 211/45
4,081,080 A * 3/1978 Rorex ..... A47B 63/00 211/55
4,083,456 A * 4/1978 Genn ..... A47F 5/00 211/128.1
4,162,014 A * 7/1979 Bobrick ..... B42F 17/08 211/126.1
4,265,038 A * 5/1981 Crosslen ..... G09F 5/00 40/124.2
4,387,810 A * 6/1983 Crosslen ..... A47F 1/04 211/128.1
4,548,324 A * 10/1985 Mackey, Jr. ..... A47F 5/02 211/129.1
4,613,047 A * 9/1986 Bushyhead ..... A47F 7/145 108/101
4,938,367 A * 7/1990 Krapf ..... A47B 63/00 211/128.1
4,949,849 A * 8/1990 Hardy ..... A47F 7/145 211/128.1
5,009,335 A * 4/1991 Jonker ..... A47F 7/145 211/128.1
5,029,715 A * 7/1991 Strada ..... A47F 7/163 211/128.1
D322,523 S * 12/1991 Brooks ..... D6/675.4
5,085,328 A * 2/1992 Evenson ..... A47F 7/147 211/184
5,222,609 A * 6/1993 Eaton ..... A47F 7/147 211/55
D349,131 S * 7/1994 Nystrom ..... D19/90
5,328,037 A * 7/1994 Fujii ..... A47F 5/0846 211/55
5,344,030 A * 9/1994 Evenson ..... A47F 7/147 211/55
5,402,896 A * 4/1995 Gould ..... A47B 81/068 206/309
5,411,135 A * 5/1995 Danzyger ..... G11B 33/0405 206/308.3
5,477,967 A * 12/1995 Voorhees ..... A47B 63/00 211/103
5,641,074 A * 6/1997 Smed ..... A47B 87/0261 211/11
5,720,396 A * 2/1998 Wegscheid ..... A47F 7/145 211/55
5,938,048 A * 8/1999 Carroll ..... A47F 7/145 211/55
6,003,259 A 12/1999 Krapf et al.
6,065,616 A * 5/2000 Velles ..... B42F 17/18 190/900
6,092,672 A * 7/2000 Harris ..... B42F 7/12 211/11
D437,168 S * 2/2001 Trees ..... D6/571
6,189,705 B1 2/2001 Saylor et al.
6,213,313 B1 * 4/2001 Levy ..... A47F 7/147 211/50
D454,461 S * 3/2002 Goldberg ..... D6/570
6,412,648 B1 * 7/2002 Woolnough ..... A47F 7/145 211/128.1
6,422,403 B1 * 7/2002 Woolnough ..... A47F 7/145 211/130.1
6,450,348 B1 * 9/2002 Lillelund ..... A47F 5/0018 211/126.2
6,530,485 B1 * 3/2003 Weber ..... A47F 7/145 211/128.1
6,533,130 B1 * 3/2003 Padiak ..... A47F 3/001 211/128.1
6,942,108 B2 * 9/2005 Wons ..... A47F 7/145 211/128.1
6,955,268 B2 * 10/2005 Waldron ..... A47F 7/145 211/194
7,104,408 B2 * 9/2006 Stravitz ..... B42F 17/02 211/11
7,713,375 B2 5/2010 Schneider
7,851,957 B2 12/2010 Krapf et al.
7,886,916 B2 * 2/2011 Alyn ..... A47F 5/0807 211/189
7,909,182 B2 * 3/2011 Maier-Hunke ..... A47F 7/146 211/50
8,096,426 B2 * 1/2012 Vivas ..... B42F 7/12 206/558
8,141,280 B2 * 3/2012 Doss ..... G09D 3/02 40/107
8,313,156 B2 * 11/2012 Ross ..... A47B 23/06 312/223.3
2004/0110032 A1 6/2004 Staadecker et al.
2007/0141546 A1 * 6/2007 Kang ..... A63F 9/0641 434/408
2009/0266721 A1 * 10/2009 Bala ..... A45C 11/24 206/214

* cited by examiner

FIG. 3
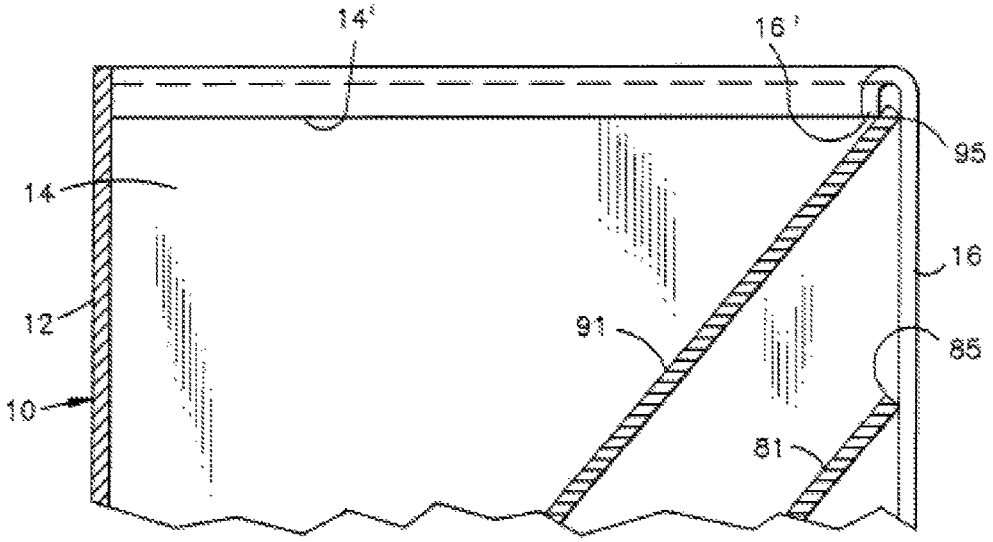
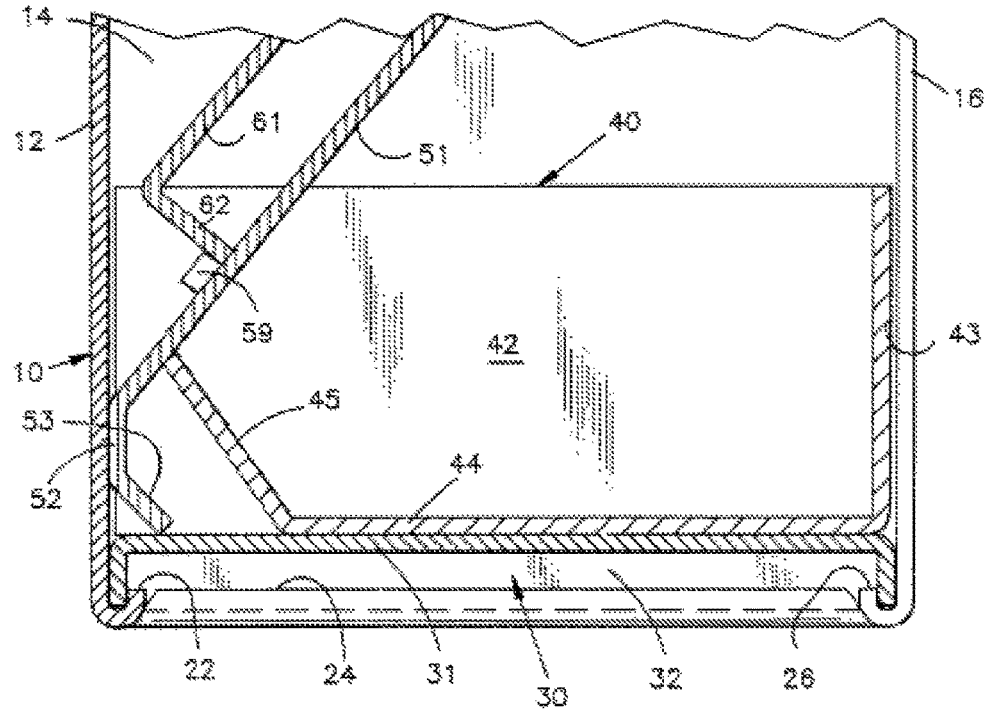
FIG. 4

DOCUMENT HOLDING APPARATUS

TECHNICAL FIELD

This application generally relates to the field of display systems and more specifically relates to a document holding or retaining apparatus having a plurality of interconnected partitions or dividers that are disposed in a staggered, interlocking configuration. The plurality of interconnected dividers are supported within a peripheral frame having a defined channel that is sized to enable document retaining pockets created between adjacent dividers to be selectively and independently expanded. The herein described document holding apparatus can be used as a single device or can be used in various combinations with other display systems, such as those having dry-erase ("white") boards and the like.

BACKGROUND

Applicant has previously designed and successfully commercialized a document holding device, which is more completely described in U.S. Pat. No. 4,938,367. Referring to FIGS. 1-4, this document holding device is defined by a sheet metal support frame or housing 10 that includes a back wall 12, as well as a pair of spaced side walls 13 and 14 which are bent at right angles relative to the back wall 12. A plurality of sheet metal dividers or partitions 41, 51, 61, etc, are disposed within the marginal portions of the support frame 10, the dividers being vertically stacked therein. According to this particular design, at least one of the plurality of dividers is separately and commonly attached to the back wall 12 using attachment members 58, 59, see FIG. 2, that interconnect adjacent dividers to one another as well as the back wall 12 of the frame 10.

While the above document retaining device provides a convenient means for retaining a plurality of documents, such as filed folders and the like, there is still a general need in the field to improve manufacture of the apparatus and also provide greater versatility such as through integration of the document retaining assemblies with other display systems, such as at least one dry-erase or other form of display board.

BRIEF DESCRIPTION

Therefore and according to one aspect, there is provided a document holding apparatus comprising a plurality of flexible dividers. Each flexible divider includes at least one fastening member that secures to a corresponding fastening member of an adjacent divider to create a staggered vertical arrangement of dividers having document retaining pockets formed between adjacent dividers. The document holding apparatus further includes a peripheral frame that supports edge surfaces of the staggered dividers, the frame including an extruded section having a formed channel that permits the capacity of any of the document retaining pockets to be individually and selectively increased, as needed.

In at least one version, the dividers each include at least one tab member adjacent a bottom edge that is sized to engage a corresponding slot formed within a lower portion of an adjacent divider.

According to at least one embodiment, the document holding apparatus can be easily coupled to or incorporated within or as part of another display system. For example and according to one version at least one white (dry-erase) display board is supported by the apparatus within the peripheral frame for a wall or similar structure. In another version, at least one or more document retaining apparatus, either with or without dry-erase or other display boards are provided on at least one side of a rotatable kiosk.

According to another aspect, there is provided a display apparatus comprising a plurality of flexible dividers. Each flexible divider includes at least one fastening member that secures to a corresponding fastening member of an adjacent divider to create a staggered vertical arrangement of dividers with document retaining pockets being created between adjacent dividers. The dividers can be retained within a peripheral frame. According to at least one version, the peripheral frame includes an extruded channel that receives lateral edge portions of the dividers. The channel is sufficiently sized to permit the created document storage pocket between the dividers to be individually adjusted. The display apparatus can further include at least one display board disposed in the peripheral frame and in relation to the plurality of flexible dividers.

In one version, the at least one display board is a "dry-erase" or so-called white board. According to one embodiment, the display apparatus can be a series of boards disposed in relation to a wall or cubicle surface or incorporated into a rotatable assembly, such as a rotatable kiosk.

Advantageously, the herein described document holding apparatus can be manufactured with fewer parts and more inexpensively than prior versions. In addition, the herein described apparatus is more versatile than previously known apparatus made for this purpose and permits a myriad of different configurations to be fabricated, depending on the intended application.

These and other features and advantages will be readily apparent from the following Detailed Description, which should be read in conjunction with the accompanying drawings.

BRIEF DESCRIPTION OF THE DRAWINGS

FIG. 3 is an enlarged, fragmentary sectional view taken along lines 2-2 of FIG. 2 of the document retaining apparatus;

FIG. 4 is an enlarged, fragmentary sectional view taken along lines 4-4 of FIG. 2 of the document retaining apparatus;

DETAILED DESCRIPTION

The following relates to embodiments of a document holding apparatus for independent use or for incorporation into various display systems, whether integrated therein or provided as a separate component. It will be readily apparent from this discussion that other variations and modifications of the herein described design are possible, in addition to those specifically described and having the herein described inventive aspects. In addition, certain terms are frequently used throughout this description in order to provide a suitable frame of reference with the regard to the accompanying drawings. These terms, such as "front", "rear", "lateral", "inner", "outer", "over", "under", "upper", "lower", "vertical", "horizontal" and the like are not intended, unless so specifically indicated, to narrow the intended scope of the described invention. In addition, the accompanying drawings are intended to illustrate the salient features of the apparatus, but are not provided necessarily to scale.

Figure 5:
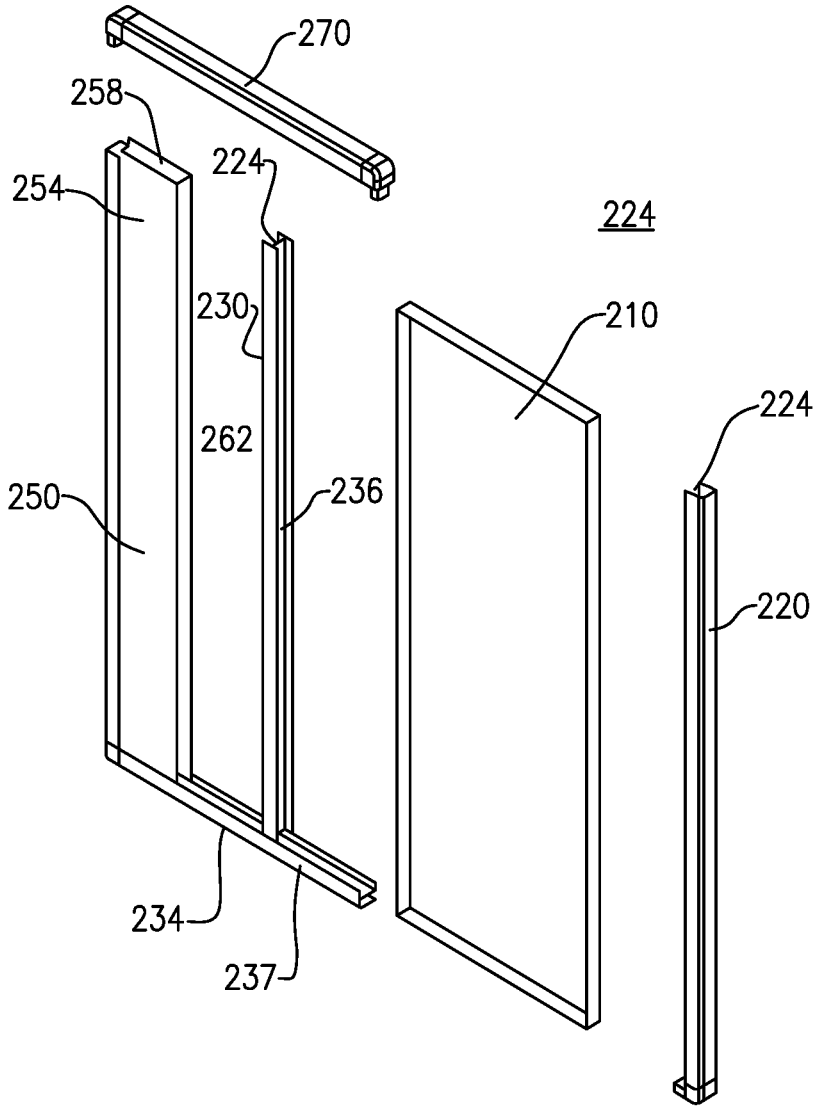
FIG. 5 is an exploded assembly view of a document holding apparatus made in accordance with an embodiment.
Figure 6:
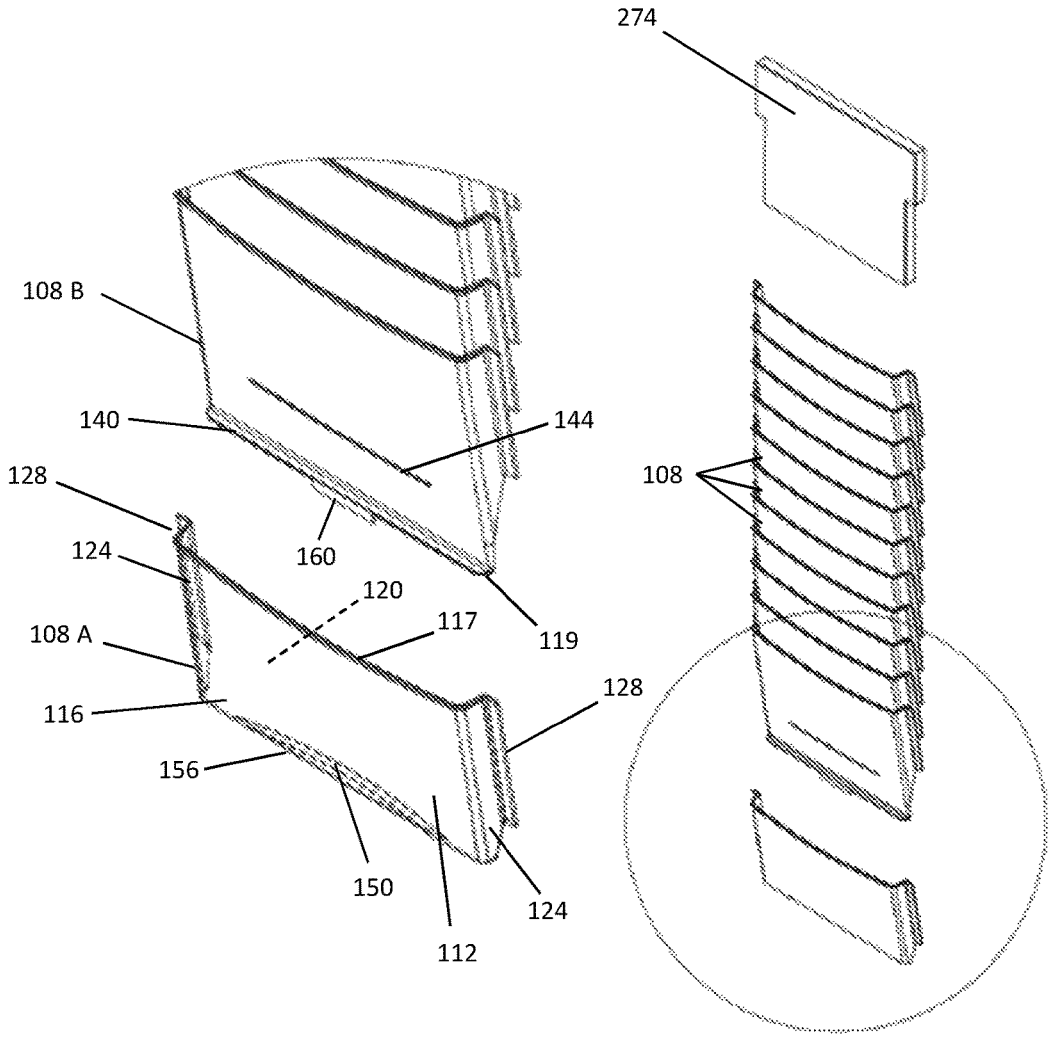
FIG. 6 is an enlarged isometric front view of a portion of the document holding apparatus of FIG. 5.
Figure 10:
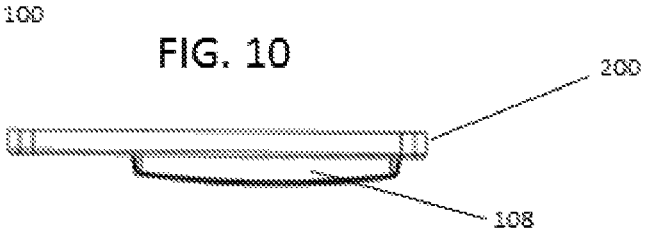
FIG. 10 is a top plan view of the document holding apparatus of FIGS. 5-9.
Figure 7:
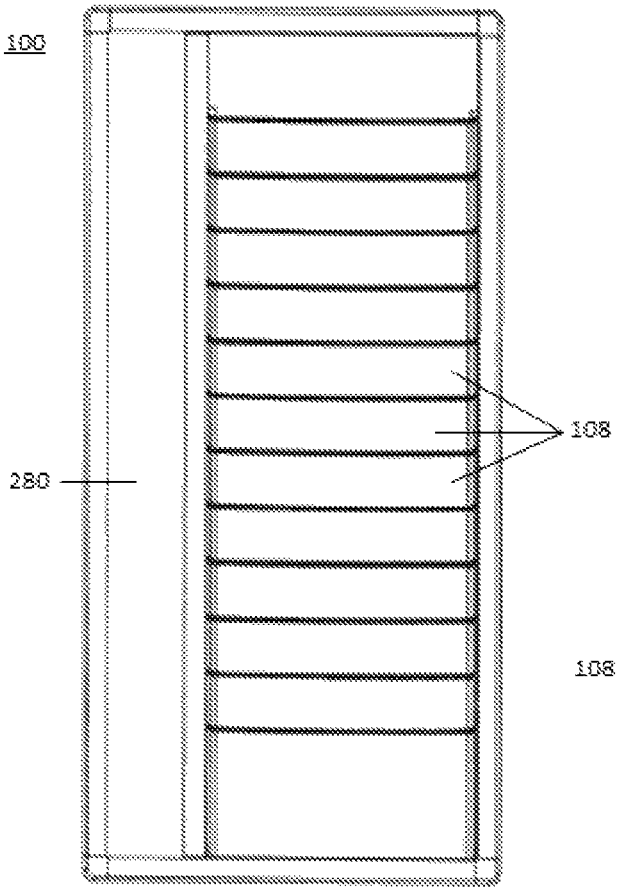
FIG. 7 is a front view of the document holding apparatus of FIGS. 5 and 6.
Figure 8:
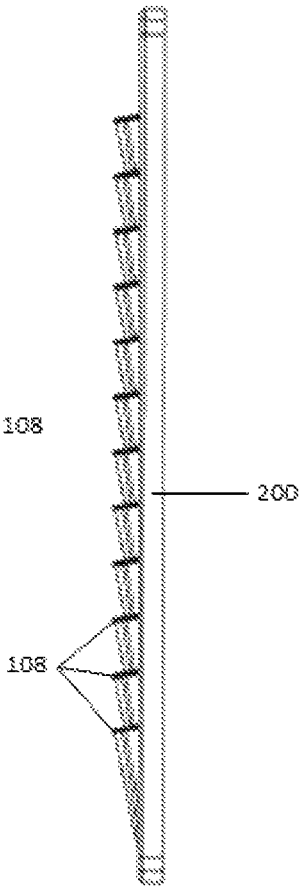
FIG. 8 is a side view of the document holding apparatus of FIGS. 5-7.
Figure 9:
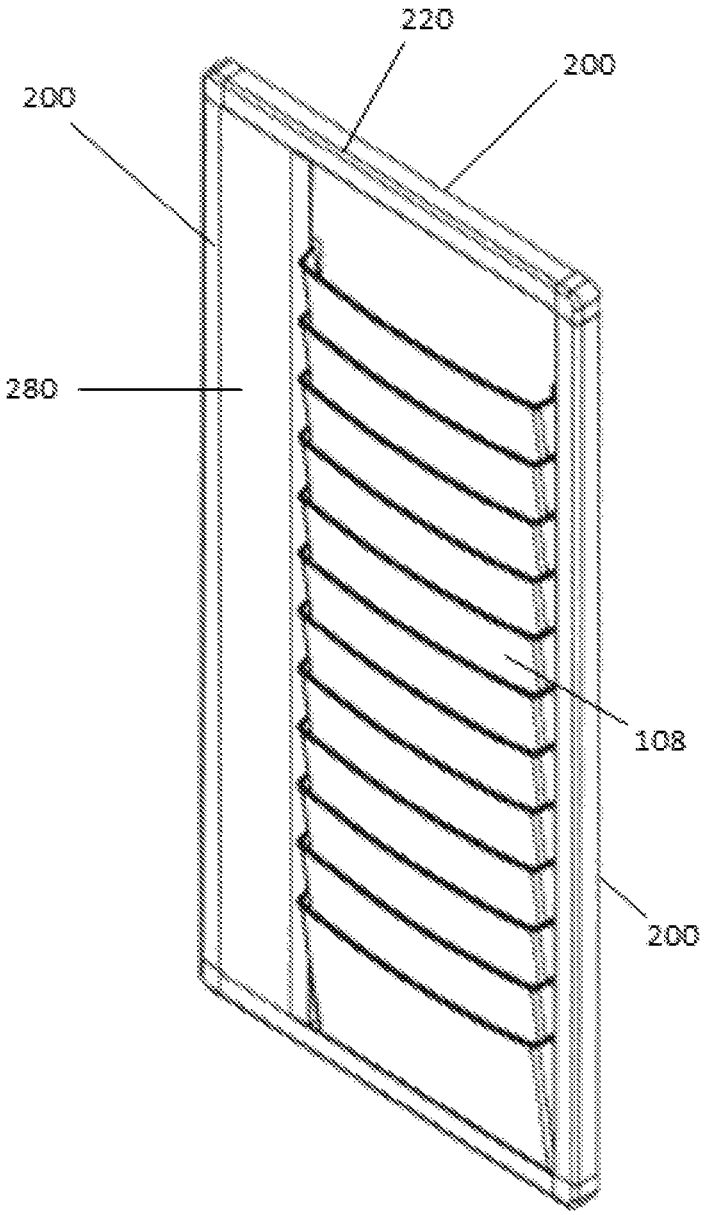
FIG. 9 is an isometric front view of the document holding apparatus of FIGS. 5-8.

With reference to FIGS. 5-10, there is provided a document holding or retaining apparatus 100 in accordance with an embodiment of the present invention. As shown in the exploded assembly view of FIG. 5, the document holding apparatus 100 includes a plurality of flexible dividers 108 that can be assembled into an interlocking arrangement within a peripheral frame 200. As will be evident from the following description, the number of dividers 108 can be suitably varied depending on the application.

The flexible dividers 108 are staggered in a nested configuration. More specifically and according to this embodiment, each individual divider 108 is preferably and entirely made from a moldable lightweight plastic. More specifically and with reference to FIG. 6, each divider 108 commonly includes a planar section 112 having respective front and rear facing surfaces, 116 and 120, a top edge 117 and an opposing bottom edge 119. Side or lateral flanges 124 project substantially transversely from the rear facing surface 120, and more specifically from opposing lateral sides of the planar section 112. Each of the side flanges 124 are defined by a tapering height relative to the rear facing surface 120 that increases from the bottom edge 119 of the divider 108 to an intermediate distance between the top and bottom edges 117, 119. A rear ledge 128 extends transversely (i.e., outwardly) from each of the side flanges 124 relative to the planar section 112 and parallel to the front and rear facing surfaces 116, 120. Each divider 108 further includes a lower flange 140 extending along the entire bottom edge 119 of the planar section 112 that projects outwardly from the front facing surface 116 of the divider 108. The lower flange 140 is perpendicular to the planar section 112 and forms a lower ledge.

According to this herein described embodiment, the planar section 112 further includes a slot or groove 144 that is centered or substantially centered relative to the side flanges 124 of the divider 108, the groove 144 being disposed between the bottommost end of the rear flange 124 and the bottom edge 119 of the divider 108. The groove 144 extends in a direction (horizontal) between the side flanges 124 of the planar section 112 but not across the entire span of the planar section 108. The rear facing surface 120 includes a section 150 that extends rearwardly and in a curved configuration from a pair of supported ends (not shown) on each side of the defined horizontally disposed slot groove 144. The curved section 150 extends outwardly relative to the rear facing surface 120 and includes a spacing 156 that is formed between the inner surface of the curved section 150 and the rear facing surface 120 of the divider 108. According to this embodiment, the curved section 150 is supported to the rear facing surface 120 at respective ends thereof by means of respective end gussets (not shown). It will be readily apparent that other suitable means for securing or integrating the curved section 150 can be utilized.

A tab portion 160 extends downwardly from the lower flange 140, the tab portion 160 being substantially centered between the side flanges 124 and extending in a direction that is parallel to the planar section 112. The top edge 117 of each divider 108 according to this embodiment includes a beaded area that further extends along the top edge of each side flange 124, as well as the rear ledge 128 in a continuous manner.

In terms of assembling the plurality of dividers 108 to one another and still referring to FIGS. 5-10, the extending tab portion 160 at the lower edge of a first divider 108A is sized to fit within the spacing 156 formed by the curved portion 150 of a second divider 108B. When fitted, the side flanges 124 of the first divider 108A are fitted within the side flanges 124 of the second divider 108B with the side ledges 128 of the first divider 108A overlapping the side ledge 128 of the second divider 108B. As assembled, the assembled dividers 108A, 108B define a document retaining pocket 150 bounded by the lower flange 140 of the second divider 108B, the side flanges 124 and rear ledges 128 of the first and second divider 108A, 108B, and the front and rear facing sides of the first and second divider 108A, 108B.

Figure 11A:
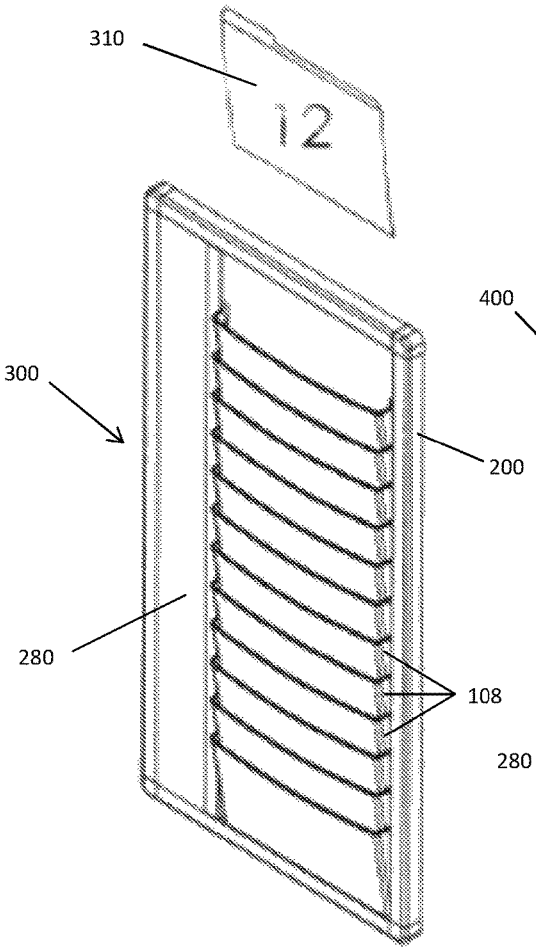
FIGS. 11(*a*)-11(*d*) illustrate front perspective views of multiple versions of a document holding apparatus.
Figure 11B:
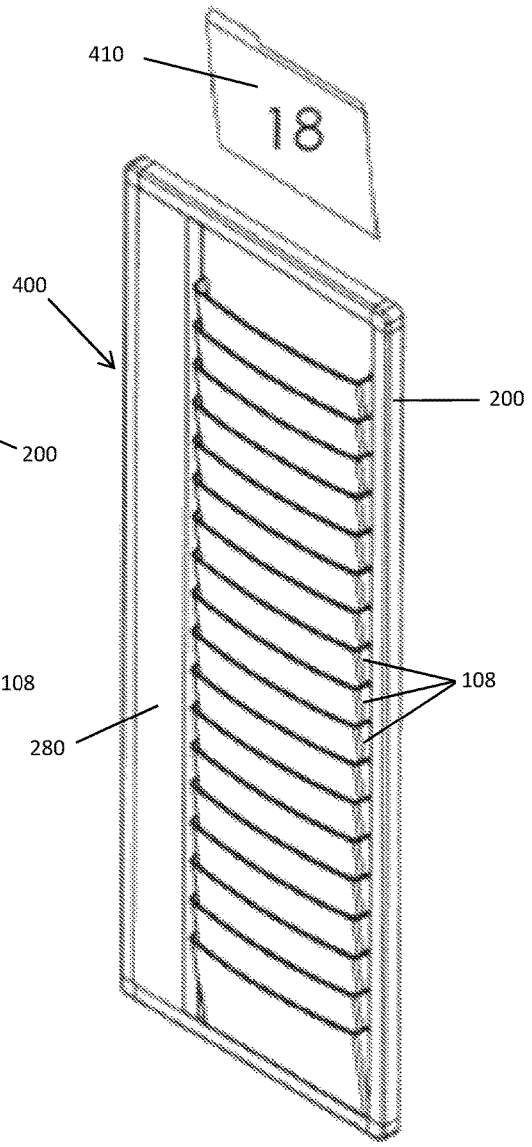
Figure 11C:
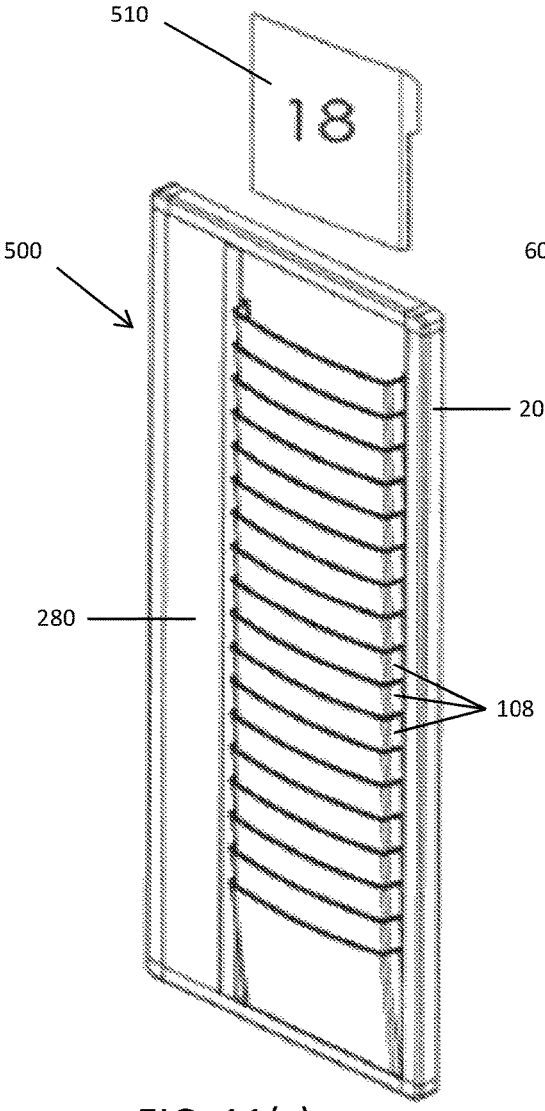
Figure 11D:
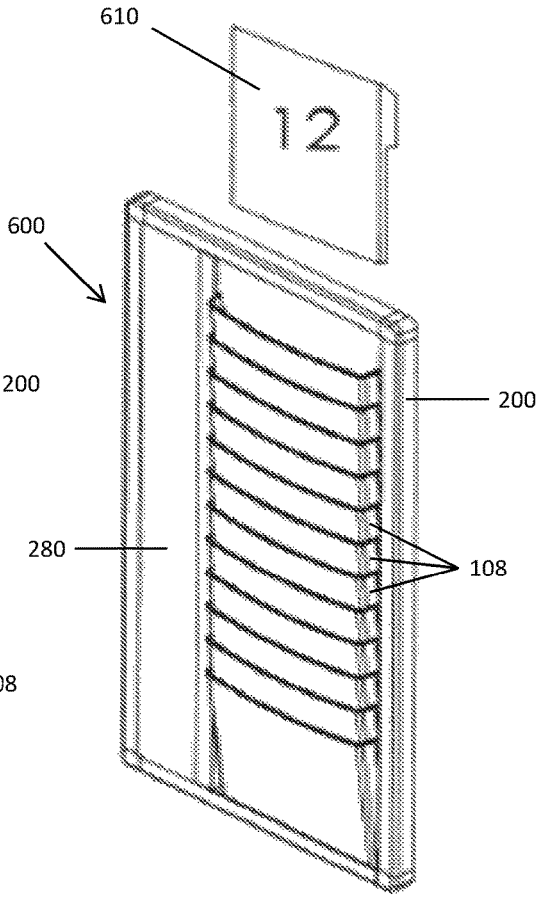

The plurality of dividers 108 can be stacked in a vertical and staggered orientation with the extending tab portions 160 of each subsequent divider 108 being engaged within the curved section 150 at the rear facing surface 120 and more specifically within the defined spacing 156. According to this depicted version, the horizontal (length) dimension of the dividers 108 is larger than the corresponding vertical (height) dimension. It will be understood that other suitable configurations are possible. For example and with reference to FIGS. 11(*a*)-11(*d*), a set of dividers can be provided in which the horizontal dimension is smaller than the vertical dimension depending, for example, on the documents 310, 410, 510, 610 that are to be retained by the herein described apparatus 100 (or the alternative document holding apparatus 300, 400, 500, 600 shown in FIGS. 11(*a*)-11(*d*)).

The vertical staggered configuration retains each of the dividers 108 in a secure, but releasable manner. The peripheral frame 200 retains the dividers in a stable manner, but further enables each individual document retaining folder to be expanded as needed. The peripheral frame 200 is now discussed in greater detail. A support 210 is configured and sized to retain the plurality of dividers 108. The support 210 according to this embodiment is defined by a planar surface serving as a rear side of the completed apparatus 100 as well as respective side, top and bottom edges forming a perimeter. The support 210 can be fabricated from aluminum, steel, plastic or other suitable structural material.

According to this embodiment, a pair of frame sections 220 and 230 are sized and attached to the side edges of the support 210, as well as the side ledges of the plurality of dividers 108. Each of the frame sections 220, 230 are made from a lightweight structural metal, such as aluminum, and include a defined inwardly facing slot or channel 224 that is sized and configured to accommodate the side edges of the support 210, as well as the rear ledges 128 of the plurality of the dividers 108. Each formed channel 224 is defined by a width dimension of sufficient size that permits the side ledges 128 of the retained dividers 108 to pivot and selectively (independently) expand the holding capacity of a defined document retaining pocket 150 by pulling one of the dividers 108 toward the user.

The frame section 220 is configured to receive one side edge of the support 210 including the side ledges 128 of the plurality of dividers 108 within the formed channel 224 and further is shaped and configured to receive and retain a lower corner of the support 210. The frame section 230 is defined by a bottom portion 234 and a side portion 236. The side portion 236 effectively mirrors the frame section 220 and covers the opposing side edge of the support 210, as well as the side ledges of the plurality of dividers 108 within the formed channel 224. The side portion 236 extends transversely from the bottom portion 234 at an intermediate location along the length thereof with an extending part 237 of the bottom portion 234 being sized and configured to retain a lower portion of the support 210 within a defined slot or channel 224.

A separate frame section 250 extends transversely from the bottom portion 234 and is spaced from the side portion 236. This frame section 250 includes respective front and rear surfaces 254, 258 that contribute to define a spaced region 262 that is sized and configured to receive a white board 280, shown in FIGS. 11(*a*)-11(*d*). A top frame section 270 is sized and configured to peripherally cover each of the frame sections 220, 230, 250 as well as the support 210. Optionally, a spacer 274 can be introduced relative to the uppermost of the dividers 108 within the support 210.

Alternatively, each of the sections 220, 230, 250, 270 of the peripheral frame 200 can be made from a molded plastic or other suitable lightweight material.

According to at least one version, the herein described document holding apparatus can used as an independent component or assembly or for retaining at least one display board, as shown in various configurations according to FIGS. 11(*a*)-11(*d*) and defining a more complete display system and represented by assemblies 300, 400, 500 and 600, respectively. In each of the illustrated embodiments, a section of the white board 250 is positioned to one lateral side of the document holding apparatus 100. White boards are typically made from a porcelain or other similarly coated steel sheet that provides a dry-erasable writing surface. Specific details relating to the design and manufacture of white boards are known to those in the field, such as described by U.S. Pat. No. 7,713,375B2 and U.S. Patent Application Publication No. 2004/0110032A1, each of which are herein incorporated by reference in their entirety. It will be readily apparent that other suitable configurations including those in which display boards are provided on either side of the document dividers.

The form of the display system that can use the herein described document holding apparatus can further assume a varied number of forms and configurations. For example, the herein described apparatus can be installed as part of an existing or created wall structure such as a cubicle. In another version, at least one document retaining apparatus, either with or without a display board, can be included as part of a rotatable kiosk. The kiosk can be defined by a base having a plurality of display surfaces that are supported in a multi-sided configuration and in which the kiosk is supported for rotational movement about a primary vertical axis. Details relating to one design of a suitable rotatable kiosk is provided in U.S. Pat. No. 7,851,957, herein incorporated by reference in its entirety. The incorporated version is defined by four (4) display surfaces that are indexed in ninety (90) degree increments. However, it will be readily apparent that the overall number of display surfaces (i.e., the number of facing sides) of the kiosk can be suitably varied as can the polygonal shape and dimensions thereof. According to this embodiment, four (4) vertically disposed display surfaces or sides are disposed, each being ninety degrees to each other. At least one of the display surfaces can include a document holding apparatus, such as shown in FIG. 5-10. According to this embodiment, one display surface of the rotatable kiosk includes the document holding apparatus although it will be understood that other variations are possible. For example and in one version, all four (4) display surfaces can include (partially or otherwise) a document holding apparatus. In another version, only a portion of at least one of the display surfaces can include the document holding apparatus.

Figure 1:
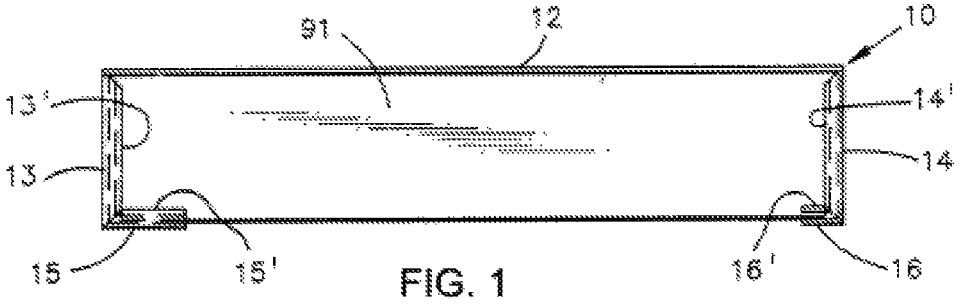
FIG. 1 is a plan view of a known document retaining apparatus.
Figure 2:
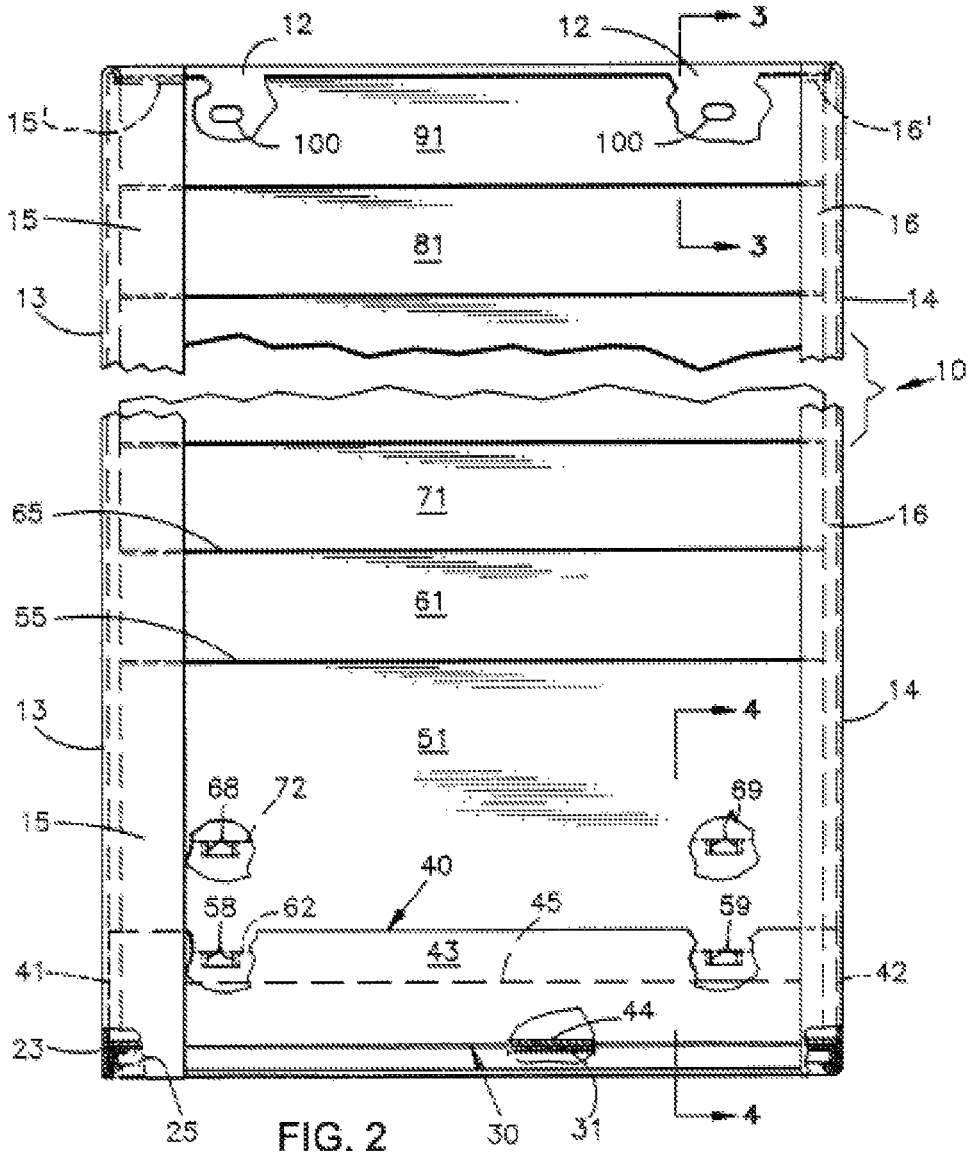
FIG. 2 is a fragmentary front elevational view of the document retaining apparatus of FIG. 1.

PARTS LIST FOR FIGS. 1-11(*d*)

10 support frame or housing
12 back wall
13 side wall
14 side wall
41 partition
51 partition
58 attachment member
59 attachment member
61 partition
100 apparatus, document holding
108 plurality of dividers
108A first divider
108B second divider
112 planar section, divider
116 front facing surface, divider
117 top edge, divider
119 bottom edge, divider
120 rear facing surface, divider
124 side flanges, divider
128 rear ledges, divider
140 lower flange, divider
144 horizontal slot or groove
150 curved section
153 end gussets
156 spacing
160 tab portion, extending
200 frame, peripheral
210 support
220 frame section
224 formed channel or slot
230 frame section
234 bottom portion
236 side portion
237 extending part, bottom portion
250 frame section
254 front surface
258 rear surface
262 spaced region
270 top frame section
274 spacer
300 document holding apparatus
310 document
400 document holding apparatus
410 document
500 document holding apparatus
510 document
600 document holding apparatus
610 document It will be readily apparent that other various features and modifications can be made in accordance with the inventive ambits, as further set forth in the following appended claims.

The invention claimed is:

1. An apparatus adapted to be attached to a substantially vertical surface and for holding documents, the apparatus comprising:

a peripheral frame; and a plurality of dividers, each of the dividers including a front facing surface, a rear facing surface, an upper end, a lower end, and opposing lateral sides, each lateral side having a rearwardly extending flange, and an end flange substantially parallel to the front and rear facing surfaces, the end flange extending outwardly from the rearwardly extending flange, each divider having a lower end including a first engagement member that is attached to a corresponding second engagement member formed on the rear facing surface of an adjacent divider so as to form a stacked interlocked configuration defining a plurality of document retaining pockets between front and rear facing surface of adjacently attached dividers wherein the peripheral frame includes a channel that receives the end flanges of the stacked dividers.

2. The document holding apparatus as recited in claim 1, in which the first engagement member comprises at least one tab portion and the second engagement member comprises a slot in an adjacent divider.

3. The document holding apparatus as recited in claim 2, in which the peripheral frame includes an extrusion having the channel and in which the channel is sized to permit relative pivotal movement between adjacently attached dividers to enable independent adjustment to the thickness of each of the document retaining pockets.

4. The document holding apparatus as recited in claim 3, in which the document holding apparatus is configured for attachment to a rotatable display kiosk.

5. The document holding apparatus as recited in claim 1, in which the apparatus is part of a display system.

6. The document holding apparatus as recited in claim 5, in which the display system includes at least one white board.

7. The document holding apparatus as recited in claim 6, in which the at least one white board and apparatus are both retained within the peripheral frame.

8. The document holding apparatus as recited in claim 1, wherein the channel of the peripheral frame is sized to permit movement of the end flange of each divider relative to an adjacently attached divider to permit independent adjustment of a thickness of each of the plurality of document retaining pockets.

9. A display apparatus adapted to be attached to a substantially vertical surface, the display apparatus comprising:

a document retaining apparatus comprising:

a plurality of dividers, each of the dividers including a front facing surface, a rear facing surface, an upper end, a lower end, and opposing lateral sides, each lateral side including a rearwardly extending flange and an end flange substantially parallel to the front and rear facing surfaces, the end flange extending outwardly from the rearwardly extending flange, the lower end including a first engagement member that is attached to a corresponding second engagement member formed on the rear facing surface of an adjacent divider so as to form a stacked interlocked configuration of a plurality of dividers defining a plurality of document retaining pockets between front and rear facing surfaces of adjacently attached dividers;

a peripheral frame including a channel that receives the end flanges of the plurality of dividers; and at least one display board, in which both the document retaining apparatus and the at least one display board are commonly retained by the peripheral frame.

10. The display apparatus as recited in claim 9, in which the at least one display board includes a dry-erase display board.

11. The display apparatus as recited in claim 9, including a plurality of display boards retained by the peripheral frame.

12. The display apparatus as recited in claim 9, in which the channel is sized to permit a capacity of each document retaining pocket to be selectively and independently adjusted.

13. The display apparatus as recited in claim 9, in which the dividers are made from a moldable plastic.

14. The display apparatus as recited in claim 9, in which the first engagement member is a tab and the second engagement feature is a slot sized for receiving the tab.

15. The display apparatus of claim 9, wherein the channel of the peripheral frame is sized to permit movement of the end flange of each divider relative to an adjacently attached divider to permit independent adjustment of a thickness of each of the plurality of document retaining pockets.

16. A method for manufacturing a document retaining apparatus that is adapted to be attached to a substantially vertical surface, the method comprising:

providing a plurality of dividers, each divider having a front facing side, a rear facing side and opposing lateral sides, each lateral side having a rearwardly extending flange and an end flange substantially parallel to the front and rear facing surfaces, the end flange extending outwardly from the rearwardly extending flange;

providing engagement features on each divider to permit the dividers to be stacked in an interlocking configuration; and providing a frame including a channel that receives the end flanges of the plurality of dividers when the plurality of dividers are stacked.

17. The method as recited in claim 16, further including at least one dry erase display board supported by the frame.

18. The method as recited in claim 17, in which the at least one dry erase display board is disposed at one side of the plurality of dividers.

19. The method as recited in claim 16, wherein the engagement features comprise a tab portion extending from the lower end of each divider and a slotted portion in an adjacent divider sized to receive the tab portion to permit interconnection of the dividers in the interlocking configuration.

20. The method as recited in claim 16, wherein the channel is sized to permit relative movement of one divider relative to the remaining dividers.

* * * * *